US011624099B2

(12) United States Patent
Lee et al.

(10) Patent No.: US 11,624,099 B2
(45) Date of Patent: Apr. 11, 2023

(54) SUPERPLASTIC MEDIUM MANGANESE STEEL AND METHOD OF PRODUCING THE SAME

(71) Applicant: INDUSTRY-ACADEMIC COOPERATION FOUNDATION, YONSEI UNIVERSITY, Seoul (KR)

(72) Inventors: Young-Kook Lee, Seoul (KR); Jeongho Han, Incheon (KR); Seok-Hyeon Kang, Asan-si (KR)

(73) Assignee: INDUSTRY-ACADEMIC COOPERATION FOUNDATION, YONSEI UNIVERSITY, Seoul (KR)

( * ) Notice: Subject to any disclaimer, the term of this patent is extended or adjusted under 35 U.S.C. 154(b) by 0 days.

(21) Appl. No.: 17/533,295

(22) Filed: Nov. 23, 2021

(65) Prior Publication Data

US 2022/0081735 A1 Mar. 17, 2022

Related U.S. Application Data

(62) Division of application No. 15/854,063, filed on Dec. 26, 2017, now abandoned.

(30) Foreign Application Priority Data

Dec. 28, 2016 (KR) ..... 10-2016-0180901
Dec. 14, 2017 (KR) ..... 10-2017-0171858

(51) Int. Cl.

| | |
|---|---|
| ***C21D 9/46*** | (2006.01) |
| ***C22C 38/00*** | (2006.01) |
| ***C22C 38/12*** | (2006.01) |
| ***C22C 38/06*** | (2006.01) |
| ***C21D 8/02*** | (2006.01) |

(Continued)

(52) U.S. Cl.

CPC ..... *C21D 9/46* (2013.01); *C21D 6/005* (2013.01); *C21D 8/0205* (2013.01); *C21D 8/0226* (2013.01); *C21D 8/0236* (2013.01); *C21D 8/0273* (2013.01); *C22C 38/002* (2013.01); *C22C 38/04* (2013.01); *C22C 38/06* (2013.01); *C22C 38/12* (2013.01); *C21D 2211/001* (2013.01); *C21D 2211/005* (2013.01)

(58) Field of Classification Search

CPC ..... C21D 9/46; C21D 8/0226; C21D 8/0236; C21D 8/0273; C21D 6/005; C21D 8/0205; C21D 2211/001; C21D 2211/005; C21D 8/0247; C22C 38/002; C22C 38/12; C22C 38/06; C22C 38/04; C22C 38/02; C22C 38/32

See application file for complete search history.

(56) References Cited

U.S. PATENT DOCUMENTS

2016/0281196 A1* 9/2016 Huang ..... C22C 38/06
2016/0312323 A1* 10/2016 Rana ..... C22C 38/06
2016/0340761 A1* 11/2016 Garza-Martinez ..... C22C 38/12

* cited by examiner

*Primary Examiner* — John A Hevey
(74) *Attorney, Agent, or Firm* — Lex IP Meister, PLLC

(57) ABSTRACT

A superplastic medium manganese steel according to the present invention preferably has a composition containing 4 to 8 wt. % of manganese (Mn) and 3 wt. % or less (excluding 0 wt. %) of aluminum (Al), with the remainder being iron (Fe) and inevitable impurities. In another embodiment, a superplastic medium manganese steel according to the present invention preferably has a composition containing 4 to 8 wt. % of manganese (Mn) and 3 wt. % or less (excluding 0 wt. %) of silicon (Si), with the remainder being iron (Fe) and inevitable impurities.

9 Claims, 15 Drawing Sheets

(51) Int. Cl.
*C21D 6/00* (2006.01)
*C22C 38/04* (2006.01)

SUPERPLASTIC MEDIUM MANGANESE STEEL AND METHOD OF PRODUCING THE SAME

BACKGROUND

1. Technical Field

The present invention relates to a superplastic medium manganese steel and a method of producing the same. More particularly, the present invention relates to a superplastic medium manganese steel which does not contain expensive components, such as chromium (Cr), nickel (Ni) or the like, and which exhibits superplasticity without requiring a complicated pretreatment process, and also relates to a method of producing the same.

2. Description of the Related Art

The global demand for automotive steel sheets is expected to continue to grow from about 80 million tons produced in 2015, and the demand for lightweight vehicles is also increasing due to more stringent fuel economy regulations in each country. Accordingly, there is an increasing demand for non-ferrous materials for the purpose of reducing the weight of the vehicle body. However, high formability/high strength steel sheets obtained by improving existing steel materials will occupy more than 80% of automotive steel sheets in the future due to their lightweight, processing ease and economic advantages. A ferrous superplastic steel sheet produced according to the present invention is expected to satisfy the needs of the present industry due to its low production cost, high formability at high temperatures, and high strength after forming.

From the viewpoint of improvement in the formability of automotive steel sheets, superplasticity has attracted attention. As used herein, the term "superplasticity" refers to a phenomenon which is caused by grain boundary sliding (other than plastic deformation, dislocation or slip) when materials with fine grain size are tensile-strained at temperatures above half of their melting point so as to exhibit extremely high ductility (300%) at very low deformation stress. Namely, at deformation temperatures at which materials exhibit superplasticity, the materials have low strength and very high ductility, and thus it is possible to form or process complex shapes even via a small amount of force.

Previous studies on superplastic materials have focused on aluminum alloys and zinc alloys, and studies on steel alloys have also been conducted.

For superplastic steel alloys, two types of alloys have been mainly researched. The first type of alloy includes duplex stainless steels with ferrite-austenite dual-phase structure, which retain a fine grain size at high temperatures due to high chromium (Cr) and nickel (Ni) content. The second type of alloy includes high-carbon steels in which fine carbides act as austenite nucleation sites at room temperature and which retain a fine grain size at high temperatures.

Previous studies have been conducted extensively on steel alloy compositions for exhibiting superplasticity and on rolling conditions, annealing conditions, and the like during production processes. Furthermore, it is known that both the two types of steel alloy show excellent formability corresponding to a maximum elongation of over 1000% when deformed at a temperature of about 700 to 1200° C.

However, to exhibit superplasticity, duplex stainless steels should have a high Cr content (23 to 34 wt. %) and a high Ni content (4 to 22 wt. %), and sometimes require a high cold-rolling reduction ratio (about 90%). In this case, chromium (Cr) and nickel (Ni) are expensive components that cause an increase in the production cost.

High-carbon steel has a total alloying element content lower than that of duplex stainless steel, but requires complicated pretreatment processes, such as warm rolling and repeated rolling-annealing. Namely, in the production of conventional ferrous superplastic alloys, there is a great economic loss.

In summary, among conventional ferrous superplastic steels, stainless steels have an advantage in that they are treated by a general annealing process, and thus do not require complicated pretreatment processes, but have a disadvantage in that they contain extensive Cr and Ni components which significantly increase the production cost. High-carbon steels have an advantage in that the production cost is reduced because expensive Cr and Ni components are not used, but have the disadvantage of requiring complicated pretreatment processes.

Accordingly, the present invention is intended to provide a superplastic steel which combines only the advantages of the above-described steels. Namely, the present invention is intended to provide a superplastic steel whose production cost is reduced because expensive Cr and Ni components are not used and which exhibits superplasticity as a result of performing a general annealing process instead of a complicated pretreatment process.

PRIOR ART DOCUMENT

[Patent Document]

(Patent Document 1) Korean Patent No. 1387551 (issued on Apr. 15, 2014).

SUMMARY

The present invention has been conceived to overcome the above-described problems, and an object of the present invention is to provide a superplastic medium manganese steel which exhibits superplasticity without containing expensive components, such as chromium (Cr), nickel (Ni) or the like, and a method of producing the same.

Another object of the present invention is to provide a superplastic medium manganese steel which exhibits superplasticity without a complicated pretreatment process, and a method of producing the same.

The objects of the present invention are not limited to those mentioned above, and other objects which are not mentioned herein will be clearly understood by a person skilled in the art from the following description.

A superplastic medium manganese steel according to the present invention has a composition containing 4 to 8 wt. % of manganese (Mn) and 3 wt. % or less (excluding 0 wt. %) of aluminum (Al), with the remainder being iron (Fe) and inevitable impurities.

A superplastic medium manganese steel according to the present invention has a composition containing 4 to 8 wt. % of manganese (Mn) and 3 wt. % or less (excluding 0 wt. %) of silicon (Si), with the remainder being iron (Fe) and inevitable impurities.

The superplastic medium manganese steel according to the present invention may further contain 0.2 wt. % or less (excluding 0 wt. %) of niobium (Nb).

The superplastic medium manganese steel according to the present invention may further contain 0.03 wt. % or less (excluding 0 wt. %) of boron (B).

The superplastic medium manganese steel according to the present invention may further contain 0.2 wt. % or less (excluding 0 wt. %) of carbon (C).

The medium manganese steel according to the present invention is annealed in the temperature range of a ferrite-austenite dual-phase region to form ferrite and austenite.

In the present invention, the temperature range of the dual-phase region preferably ranges from 600 to 900° C.

In the present invention, each of ferrite and austenite formed in the temperature range of the dual-phase region preferably has an average grain diameter of 2 μm or less.

A method of producing a superplastic medium manganese steel according to the present invention includes the steps of: (S1) melting a medium manganese steel having the composition according to the present invention, and then homogenizing the medium manganese steel; (S2) hot-rolling the homogenized medium manganese steel; (S3) cooling the hot-rolled steel; (S4) cold-rolling the cooled steel; and (S5) annealing the cold-rolled steel at a predetermined elevated temperature.

In the present invention, the temperature for the homogenizing in step (S1) is preferably 1200° C., and the melting in step (S1) is preferably performed at a temperature equal to or higher than the homogenizing temperature.

In the present invention, the hot-rolling in step (S2) is preferably performed at a temperature in the range of 1000 to 1200° C.

In the present invention, step (S3) may be performed by any one cooling method selected from among water quenching, oil quenching and air cooling.

In the present invention, the cold-rolling in step (S4) is preferably performed at a reduction ratio of 90% or less (excluding 0%), more preferably 60 to 80%.

In the present invention, the cold rolling in step (S4) may be performed at room temperature.

In the present invention, a dual-phase formed in step (S5) is preferably ferrite and austenite.

In the present invention, the annealing in step (S5) is preferably performed in the temperature range of a ferrite-austenite dual-phase region, and the temperature range of the ferrite-austenite dual-phase region preferably ranges from 600 to 900° C.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
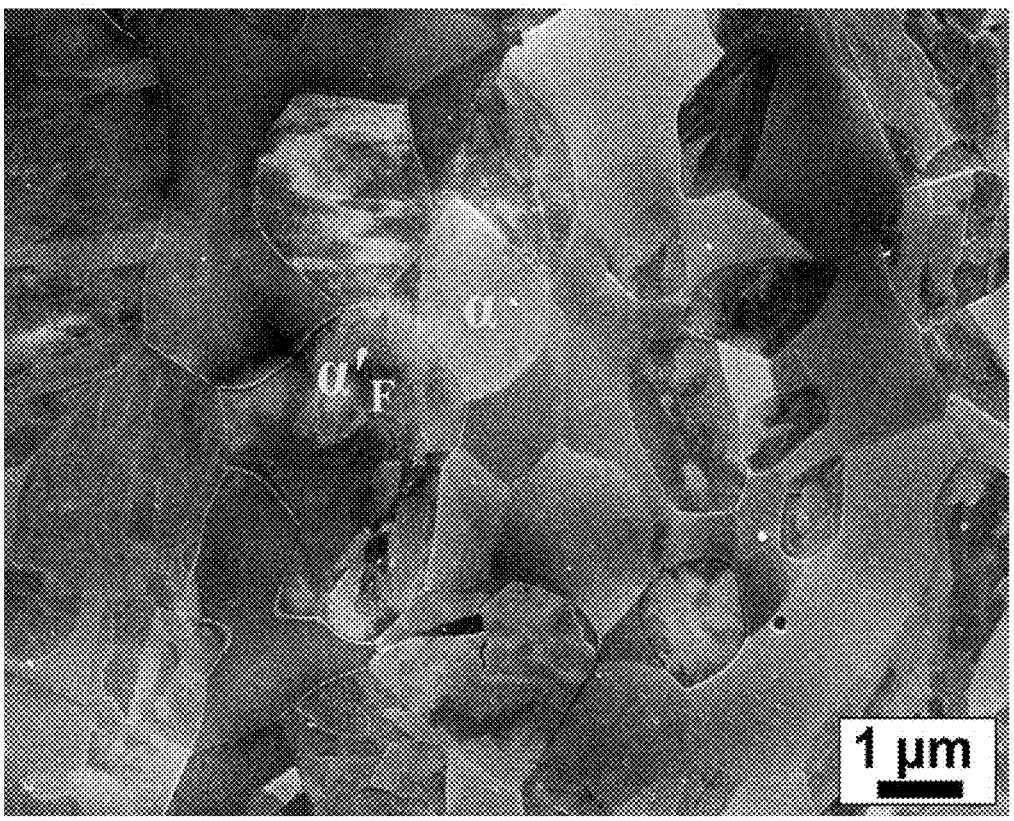
FIG. 1 shows the microstructure of a specimen that was obtained by cold-rolling inventive steel 1 at a reduction ratio of 60% and then maintaining inventive steel 1 at 850° C. for 5 minutes, followed by water quenching.

Embodiments of the present disclosure will be described in detail below with reference to the accompanying drawings so that a person having ordinary knowledge in the art to which the present invention pertains can easily practice the present invention. As can be understood by a person having ordinary knowledge in the art to which the present invention pertains, the following embodiments may be modified in various forms without departing from the technical spirit and scope of the present invention. Throughout the accompanying drawings, the same or similar components are designated by the same or similar reference symbols as much as possible.

The technical terms used herein are used merely to describe specific embodiments, and are not intended to limit the present invention. Each singular expression used herein may include a plural expression unless clearly defined otherwise.

The term "include" or "comprise" used herein specifies a specific feature, region, integer, step, operation, element, or component, but does not exclude the presence or addition of a different specific feature, region, integer, step, operation, element, component, or group.

All terms including technical terms and scientific terms used herein have the same meanings as commonly understood by those having ordinary knowledge in the art to which the present invention pertains. Terms defined in commonly used dictionaries should be interpreted as having meanings consistent with relevant art documents and the present disclosure, and should not be interpreted in an ideal or overly formal sense unless expressly so defined herein.

The present invention is directed to a method of producing a novel ferrous superplastic steel that overcomes the problems of conventional ferrous superplastic steels, and encompasses alloy composition ranges, pretreatment processes, and conditions for the exhibition of superplasticity.

Medium manganese steels according to the present invention may include various examples as shown in Table 1 below. However, in the following description, the present invention will be described with a focus on examples of inventive steels 1 to 4.

TABLE 1

| | |
|---|---|
| Fe—Mn—Al-based steel (inventive steel 1) | Fe—Mn—Si-based steel (inventive steel 2) |
| Fe—Mn—Al—Nb-based steel (inventive steel 3) | Fe—Mn—Si—Nb-based steel |
| Fe—Mn—Al—B-based (inventive steel 4) | Fe—Mn—Si—B-based steel |

TABLE 1-continued

| | |
|---|---|
| Fe—Mn—Al—C-based steel | Fe—Mn—Si—C-based steel |
| Fe—Mn—Al—Nb—C-based steel | Fe—Mn—Si—Nb—C-based steel |
| Fe—Mn—Al—B—C-based steel | Fe—Mn—Si—B—C-based steel |

A superplastic medium manganese steel according to the present invention may have a composition containing 4 to 8 wt. % of manganese (Mn) and 3 wt. % or less (excluding 0 wt. %) of aluminum (Al), with the remainder being iron (Fe) and inevitable impurities. This manganese steel corresponds to Fe—Mn—Al-based steel.

A superplastic medium manganese steel according to the present invention may have a composition containing 4 to 8 wt. % of manganese (Mn) and 3 wt. % or less (excluding 0 wt. %) of silicon (Si), with the remainder being iron (Fe) and inevitable impurities. This manganese steel corresponds to Fe—Mn—Si-based steel.

The composition of each of the superplastic medium manganese steels according to the present invention may further contain 0.2 wt. % or less (excluding 0 wt. %) of niobium (Nb). Such steels correspond to Fe—Mn—Al—Nb-based steel, and Fe—Mn—Si—Nb-based steels, respectively.

The composition of each of the superplastic medium manganese steels according to the present invention may further contain 0.03 wt. % or less (excluding 0 wt. %) of boron (B). Such steels correspond to Fe—Mn—Al—B-based steel, and Fe—Mn—Si—B-based steel, respectively.

The composition of each of the superplastic medium manganese steels according to the present invention may further contain 0.2 wt. % or less (excluding 0 wt. %) of carbon (C). Such steels correspond to Fe—Mn—Al—C-based steel, Fe—Mn—Al—Nb—C-based steel, Fe—Mn—Al—B—C-based steel, Fe—Mn—Si—C-based steel, Fe—Mn—Si—Nb—C-based steel, and Fe—Mn—Si—B—C-based steel, respectively.

The superplastic medium manganese steel according to the present invention is annealed in the temperature range of 600 to 900° C., which is the temperature range of a ferrite-austenite dual-phase region, thereby forming ferrite and austenite.

The present specification proposes: (1) the design of a medium manganese steel that exhibits superplasticity when deformed at high temperatures; (2) a method of producing the medium manganese steel; and (3) tensile conditions for the medium manganese steel. The present invention will be described in detail below.

(1) Design of Superplastic Medium Manganese Steel

Alloys according to the present invention include various steel alloys including Mn, Al, Si, Nb, B, and C with the remainder being iron and inevitable impurities (see Table 1). The reasons why the contents of alloying elements of the steel compositions as described above are limited will be described below.

Manganese (Mn): 4 to 8 wt. %

Mn is an essential element of the present invention. Mn is an element improving hardenability, suppresses austenite-to-ferrite transformation during cooling after hot rolling, and mostly forms a martensite structure. A martensite structure containing Mn, when annealed at high temperatures for superplastic deformation after cold cooling, has a fine structure of 2 μm or less due to the difference in Mn partitioning between austenite and ferrite, unlike conventional superplastic ferrous alloys, thus indicating that it is suitable for exhibiting superplasticity.

If the Mn content is less than 4 wt. %, there may be a problem in that the hardenability of the steel decreases so that ferrite is produced during cooling after hot rolling so as to form a ferrite single phase or martensite-ferrite dual-phase structure at room temperature. The ferrite produced during cooling is likely to suppress superplastic behavior due to fast recovery and grain growth during high-temperature deformation after cold rolling.

In contrast, if the Mn content is more than 8 wt. %, problems may arise in that the material cost and the production cost increase and in that the weldability of the steel decreases and a large amount of inclusion MnS is formed. In addition, an excessively high content of Mn can lower the ferrite-austenite dual-phase region temperature to cause an austenite single phase at temperatures above about half of the melting point that exhibits superplasticity, thus causing grain coarsening attributable to rapid grain growth. Therefore, in the present invention, the Mn content preferably ranges from 4 to 8 wt. %.

Aluminum (Al): 3 wt. % or Less (Excluding 0 wt. %)

This limitation is applied to steels containing Al. Like Mn, Al also partitions between austenite and ferrite phases at deformation temperatures, and thus contributes to achieving a fine grain size. Al is known as a ferrite stabilizer, and increases the ferrite-austenite dual phase region temperature to enable a ferrite-austenite dual-phase to be formed during deformation at superplastic temperatures. Materials having a dual-phase structure at superplastic temperatures have abundant interphase boundaries, and the interphase boundaries are effective in inhibiting grain growth during deformation.

In contrast, if the Al content is more than 3 wt. %, there may occur problems, including increases in the material cost and the production cost, difficulty in continuous casting, a reduction in weldability, and the like.

In addition, the addition of a large amount of Al produces ferrite at the hot-rolling temperature, in which the ferrite is likely to cause coarse grains attributable to fast recovery and grain growth during high-temperature deformation after cold rolling. Therefore, in the present invention, the Al content is preferably 3 wt. % or less (excluding 0 wt. %).

Silicon (Si): 3 wt. % or Less (Excluding 0 wt. %)

This limitation is applied to steels containing Si. Like Al, Si is a ferrite stabilizer and is known as a strong solid solution strengthening element. By virtue of the solid solution strengthening effect, Si is expected to increase the internal strength of grains at high temperatures, thereby promoting grain boundary sliding. In addition, Si is known to have an excellent effect of suppressing cementite precipitation, and is expected to suppress grain boundary sliding interference caused by cementite that can be precipitated by carbon (C) at high temperatures.

In contrast, if the Si content is more than 3 wt. %, there may occur problems, including increases in the material cost and the production cost, a decrease in cold reduction ratio, a decrease in weldability, etc. Therefore, in the present invention, the Si content is preferably 3 wt. % or less (excluding 0 wt. %).

Niobium (Nb): 0.2 wt. % or Less (Excluding 0 wt. %)

This limitation is applied to steels containing Nb. Nb is known as an element that inhibits the growth of recrystallized grains after cold rolling. The addition of Nb is expected to achieve finer grains to thus form a plurality of grain boundaries, thereby promoting grain boundary sliding.

However, if the Nb content is more than 0.2 wt. %, there may occur problems, including an increase in the material cost, the precipitation of a second phase, a reduction in recrystallization rate, etc. Therefore, in the present invention, the Nb content is preferably 0.2 wt. % or less (excluding 0 wt. %).

Boron (B): 0.03 wt. % or Less (Excluding 0 wt. %)

This limitation is applied to steels containing B. If an excessively large number of vacancies occur at grain boundaries during deformation at high-temperatures, the vacancies can grow so as to initiate and propagate cracks, thus resulting in low elongation. B is expected to segregate into grain boundaries at high temperatures to thus increase the atomic density at the grain boundaries, thereby inhibiting crack generation.

However, if the B content is more than 0.03 wt. %, the amount of B that segregates to grain boundaries at high temperatures can increase to thus inhibit grain boundary sliding. In addition, it can strain concentration during deformation due to boride precipitation at high temperatures, thus resulting in low elongation. Therefore, in the present invention, the B content is preferably 0.03 wt. % or less (excluding 0 wt. %).

Carbon (C): 0.2 wt. % or Less (Excluding 0 wt. %)

This limitation is applied to steels containing C. C is an austenite stabilizer that controls the ferrite-austenite content at high temperatures. In addition, C is an austenite-strengthening element that can strengthen the inside of grains to thus promote grain boundary sliding. However, C is an element that diffuses rapidly between ferrite and austenite, and, in many cases, segregates to grain boundaries at high temperatures. The amount of C that segregates is maximally 4 times larger than the amount of alloying elements, and is particularly large at grain boundaries.

If the C content is more than 0.2 wt. %, the amount of C that segregates to grain boundaries at high temperatures can increase to thus inhibit grain boundary sliding. Furthermore, it can be precipitated as cementite at temperatures higher than about half of the melting temperature (which is superplastic temperature) to thus cause stress concentration during deformation, thus resulting in low elongation. Meanwhile, a high C content can result in a decrease in weldability. Therefore, in the present invention, the C content is preferably 0.2 wt. % or less (excluding 0 wt. %).

Table 2 below shows tensile properties that appear in each type of steel during deformation at high temperatures. The deformation temperature in Table 2 is defined as the temperature at which the ratio of ferrite to austenite in each type of steel is 1:1.

TABLE 2

| | Composition (wt. %) | | Deformation temperature | Strain rate | Elongation | |
|---|---|---|---|---|---|---|
| | Mn | Al | (° C.) | ($s^{-1}$) | (%) | Pretreatment |
| Inventive steel 1 | 6.6 | 2.3 | 850 | $1 \times 10^{-1}$ | 241 | 1. Cold reduction ratio: 60% 2. 5 minutes of maintenance at deformation temperature, followed by deformation |
| | | | | $1 \times 10^{-2}$ | 596 | |
| | | | | $1 \times 10^{-3}$ | 1014 | |
| Comparative steel 1 | 6.7 | 0.1 | 645 | $1 \times 10^{-1}$ | 30 | |
| | | | | $1 \times 10^{-2}$ | 78 | |
| | | | | $1 \times 10^{-3}$ | 233 | |
| Comparative steel 2 | 8.5 | 0.1 | 620 | $1 \times 10^{-3}$ | 137 | |

Table 3 below summarizes tensile properties that appear during the high-temperature deformation of steels produced according to the method of the present invention.

TABLE 3

| | Composition (wt. %) | | | | | Deformation temperature | Strain rate | Elongation | |
|---|---|---|---|---|---|---|---|---|---|
| | Mn | Al | Si | Nb | B | (° C.) | ($s^{-1}$) | (%) | Pretreatment |
| Inventive steel 1 | 6.6 | 2.3 | 0 | 0 | 0 | 650 | $1 \times 10^{-1}$ | 100 | 1. Cold reduction ratio: 80% 2. 5 minutes of maintenance at deformation temperature, followed by deformation |
| | | | | | | | $1 \times 10^{-2}$ | 186 | |
| | | | | | | | $1 \times 10^{-3}$ | 450 | |
| | | | | | | 700 | $1 \times 10^{-1}$ | 158 | |
| | | | | | | | $1 \times 10^{-2}$ | 306 | |
| | | | | | | | $1 \times 10^{-3}$ | 705 | |
| | | | | | | 800 | $1 \times 10^{-1}$ | 247 | |
| | | | | | | | $1 \times 10^{-2}$ | 867 | |
| | | | | | | | $1 \times 10^{-3}$ | 1196 | |
| | | | | | | 850 | $1 \times 10^{-1}$ | 337 | |
| | | | | | | | $1 \times 10^{-2}$ | 1113 | |
| | | | | | | | $1 \times 10^{-3}$ | 1314 | |
| | | | | | | | $1 \times 10^{-4}$ | 848 | |
| | | | | | | 900 | $1 \times 10^{-1}$ | 382 | |
| | | | | | | | $1 \times 10^{-2}$ | 962 | |
| | | | | | | | $1 \times 10^{-3}$ | 971 | |
| Inventive steel 2 | 7.02 | 0 | 2.04 | 0 | 0 | 600 | $1 \times 10^{-1}$ | 48 | |
| | | | | | | | $1 \times 10^{-2}$ | 58 | |
| | | | | | | | $1 \times 10^{-3}$ | 387 | |
| | | | | | | 650 | $1 \times 10^{-1}$ | 124 | |
| | | | | | | | $1 \times 10^{-2}$ | 269 | |
| | | | | | | | $1 \times 10^{-3}$ | 871 | |

TABLE 3-continued

| | Composition (wt. %) | | | | | Deformation temperature | Strain rate | Elongation | |
|---|---|---|---|---|---|---|---|---|---|
| | Mn | Al | Si | Nb | B | (° C.) | ($s^{-1}$) | (%) | Pretreatment |
| | | | | | | 700 | $1 \times 10^{-1}$ | 204 | |
| | | | | | | | $1 \times 10^{-2}$ | 610 | |
| | | | | | | | $1 \times 10^{-3}$ | 1000 | |
| Inventive steel 3 | 6.67 | 2.26 | 0 | 0.05 | 0 | 850 | $1 \times 10^{-1}$ | 291 | |
| | | | | | | | $1 \times 10^{-2}$ | 745 | |
| | | | | | | | $1 \times 10^{-3}$ | 1072 | |
| Inventive steel 4 | 6.69 | 2.28 | 0 | 0 | 0.003 | 850 | $1 \times 10^{-1}$ | 278 | |
| | | | | | | | $1 \times 10^{-2}$ | 770 | |
| | | | | | | | $1 \times 10^{-3}$ | 1003 | |

(2) Production Method

Figure 9:
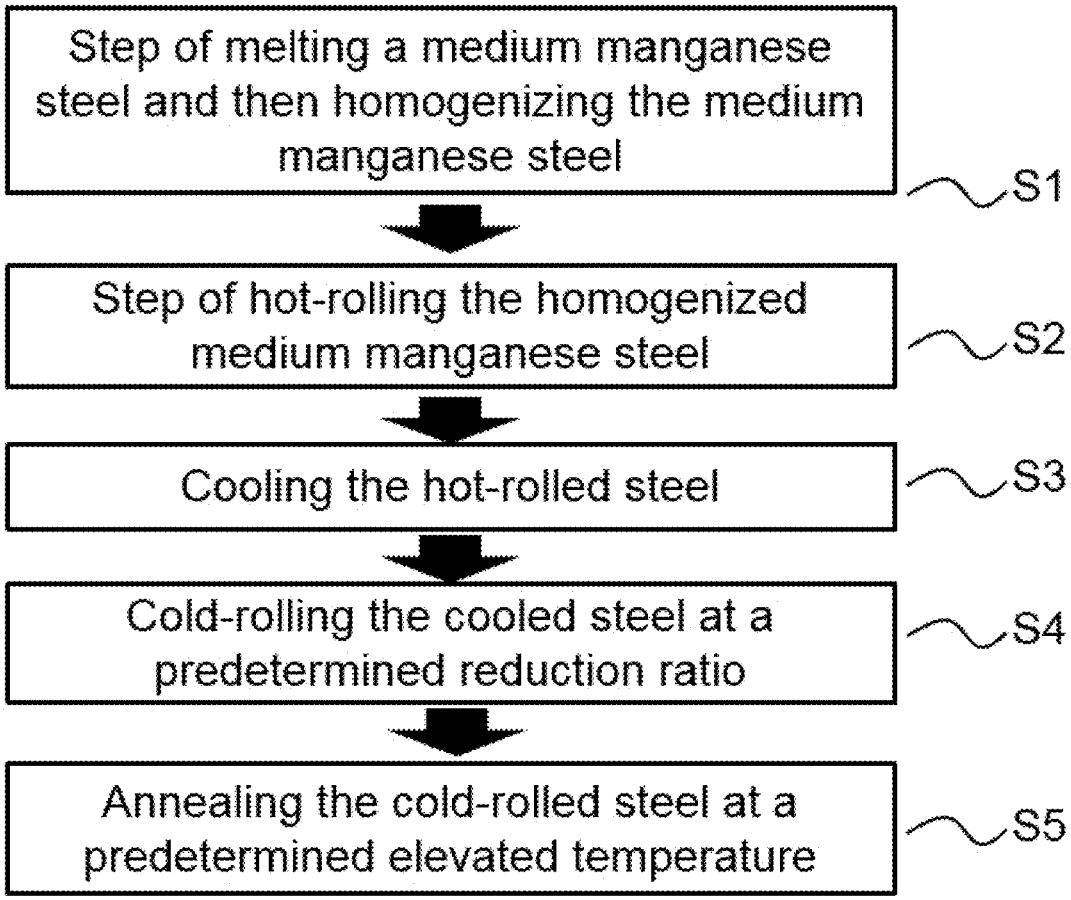
FIG. 9 illustrates a method of producing a medium manganese steel according to the present invention.

A method of producing a superplastic medium manganese steel according to the present invention will be described below. FIG. 9 illustrates a method of producing a superplastic medium manganese steel according to the present invention.

As described above, the present invention is directed a method of producing a superplastic steel which combines only the advantages of the stainless steel and high-carbon of conventional superplastic ferrous steels. Namely, the present invention is directed to a method of producing a superplastic steel whose production cost is reduced because expensive Cr and Ni are not used and which exhibits superplasticity as a result of performing a general annealing process instead of a complicated pretreatment process. The present invention is technically characterized in that a medium manganese steel having a composition according to the present invention is produced by a general annealing process without requiring a complicated pretreatment process.

The method of producing the medium manganese steel according to the present invention includes the steps of: (S1) melting a medium manganese steel having each of the compositions of various examples as described above, and then homogenizing the medium manganese steel; (S2) hot-rolling the homogenized medium manganese steel; (S3) cooling the hot-rolled steel; (S4) cold-rolling the cooled steel; and (S5) annealing the cold-rolled steel at a predetermined elevated temperature.

In the present invention, the temperature for the homogenizing in step (S1) is preferably 1200° C., and the melting temperature in step (S1) is preferably equal to or higher than the homogenizing temperature. The temperatures corresponding to step (S1) are temperatures that are generally used, and the homogenizing temperature in the present invention was set at 1200° C. In an example of the medium manganese steel according to the present invention, an ingot obtained by casting after melting was homogenized at a temperature of 1200° C. for 12 hours, and hot-rolled at a temperature of about 1000 to 1200° C., which is the temperature of austenite single phase region. After hot rolling, the steel was water-quenched or air-cooled in order to prevent ferrite from being produced during cooling. The hot-rolled steel mostly has a martensite structure. The structure after hot rolling should be mostly martensite in order to increase the possibility of achieving superplasticity through cold rolling and annealing as proposed in the present invention.

In the present invention, the hot-rolling temperature in step (S2) preferably ranges from 1000 to 1200° C. If the hot-rolling temperature is higher than 1200° C., energy loss can be caused during the hot-rolling process. If the hot-rolling temperature is lower than 1000° C., a ferrite phase can be produced during the hot-rolling process, and the produced ferrite can grow into coarse grains during subsequent superplastic deformation. This can inhibit the superplastic performance to be achieved by the present invention. For these reasons, the hot-rolling temperature preferably ranges from 1000 to 1200° C. as described above.

In the present invention, step (S3) is performed by any one cooling method selected from among water quenching, oil quenching and air cooling. In an example of the present invention, the water quenching method was selected in order to avoid ferrite transformation during cooling after hot rolling and to obtain a martensite structure. However, when the difference in microstructure after hot rolling between cooling rates was actually investigated, it could be seen that not only the water quenching method, but also the oil quenching method and the air cooling method, showed no ferrite transformation, and made it possible to obtain a martensite structure in most cases. The present invention also encompasses increasing cooling efficiency by use of a combination of the water quenching, oil quenching and air cooling methods. Meanwhile, when the fact that superplasticity is achieved by the air cooling method is taken into account, it can be seen that the actual applicability of the air cooling method to the industry is very high.

In the present invention, step (S4) is preferably performed at a reduction ratio of 90% or less (excluding 0%). The medium manganese steel according to the present invention has athermal martensite after hot rolling. A structure with fine grains can be formed at the dual-phase temperature after cold rolling by introducing deformation such as dislocation into martensite. In addition, as cold reduction ratio increases, finer grains can be obtained, and, for this reason, the reduction ratio more preferably ranges from 60 to 80%. In one example, the hot-rolled steel was cold-rolled at each of reduction ratios of 60% and 80% at room temperature.

In the present invention, the cold rolling in step (S4) may be performed at room temperature. Room temperature is generally the temperature at which steel sheets are cold-rolled, and a special additional process is not required for cold rolling at room temperature. For this reason, the cold rolling temperature in the present invention is preferably room temperature.

In the present invention, the annealing temperature in step (S5) is preferably in the temperature range of a ferrite-austenite dual-phase region. The medium manganese steel according to the present invention, when annealed, undergoes the reverse transformation of martensite structure so as to have a ferrite or austenite structure. If the annealing temperature is higher than the dual-phase region temperature, the steel will have an austenite single phase. In contrast, if the annealing temperature is lower than the dual-phase region temperature, the steel will have a ferrite single phase. In the temperature range of the dual-phase region, the steel has a ferrite-austenite dual phase, in which case grains and interphase boundaries increase.

At lower temperatures in the temperature range of the dual-phase region, the fraction of ferrite is higher. Furthermore, as the temperature increases, the fraction of ferrite decreases and the fraction of austenite increases.

It is generally known that when grain boundary sliding is activated, superplasticity is promoted. Accordingly, in the present invention, in order to achieve superplasticity using a plurality of grain boundaries, the annealing temperature was set in the temperature range of the dual-phase region. In one embodiment, the temperature range of the dual-phase region for superplastic deformation may be set to the range of 600 to 900° C.

(3) Tensile Conditions

The tensile temperature was set to a temperature in the range of 600 to 900° C. by referring to the experimental results of comparative steels shown in Table 2 above and a temperature of 1773K (1500° C.) which is the melting point of the alloy. In the given temperature range, the highest elongation is expected at the point at which the ratio of ferrite to austenite is 1:1. The reason for this is that a plurality of ferrite-austenite interphase boundaries interferes with grain growth during deformation. In addition, the reason for this is that a plurality of interphase boundaries and grain boundaries promote grain boundary sliding.

The steel was maintained for five minutes before deformation after heating up to deformation temperature so that austenite reverse transformation occurred sufficiently. In this case, microstructures at high temperatures showed a ferrite-austenite dual-phase structure having a grain size ranging from about 0.3 to 2 μm. As used herein, the term "grain size" refers to the average grain diameter of ferrite and austenite grains.

The present invention will be described with reference to the accompanying drawings below.

FIG. 1 shows the microstructure of a specimen that was obtained after inventive steel 1 had been cold-rolled at a reduction ratio of 60% and then maintained at 850° C. for 5 minutes, followed by water quenching. In FIG. 1, $\alpha$ represents ferrite, and $\alpha'_F$ represents martensite produced by transformation of high-temperature austenite during cooling. In this case, the grain size of ferrite and austenite grains is 2 μm or less. This suggests that the specimen manufactured by the production method proposed in the present invention has a fine grain size.

Figure 2:
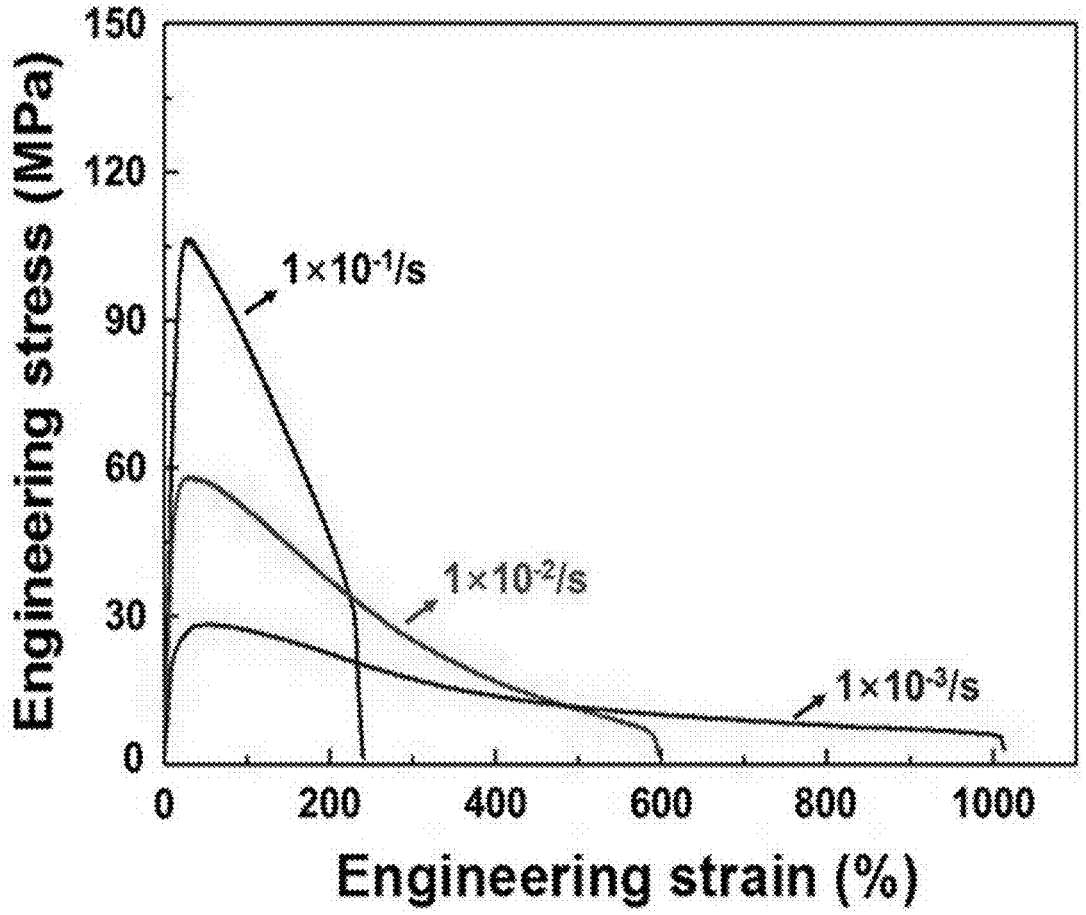
FIG. 2 shows the tensile curves of specimens at various strain rates, which were obtained by maintaining inventive steel 1 at 850° C. for 5 minutes.
Figure 3:
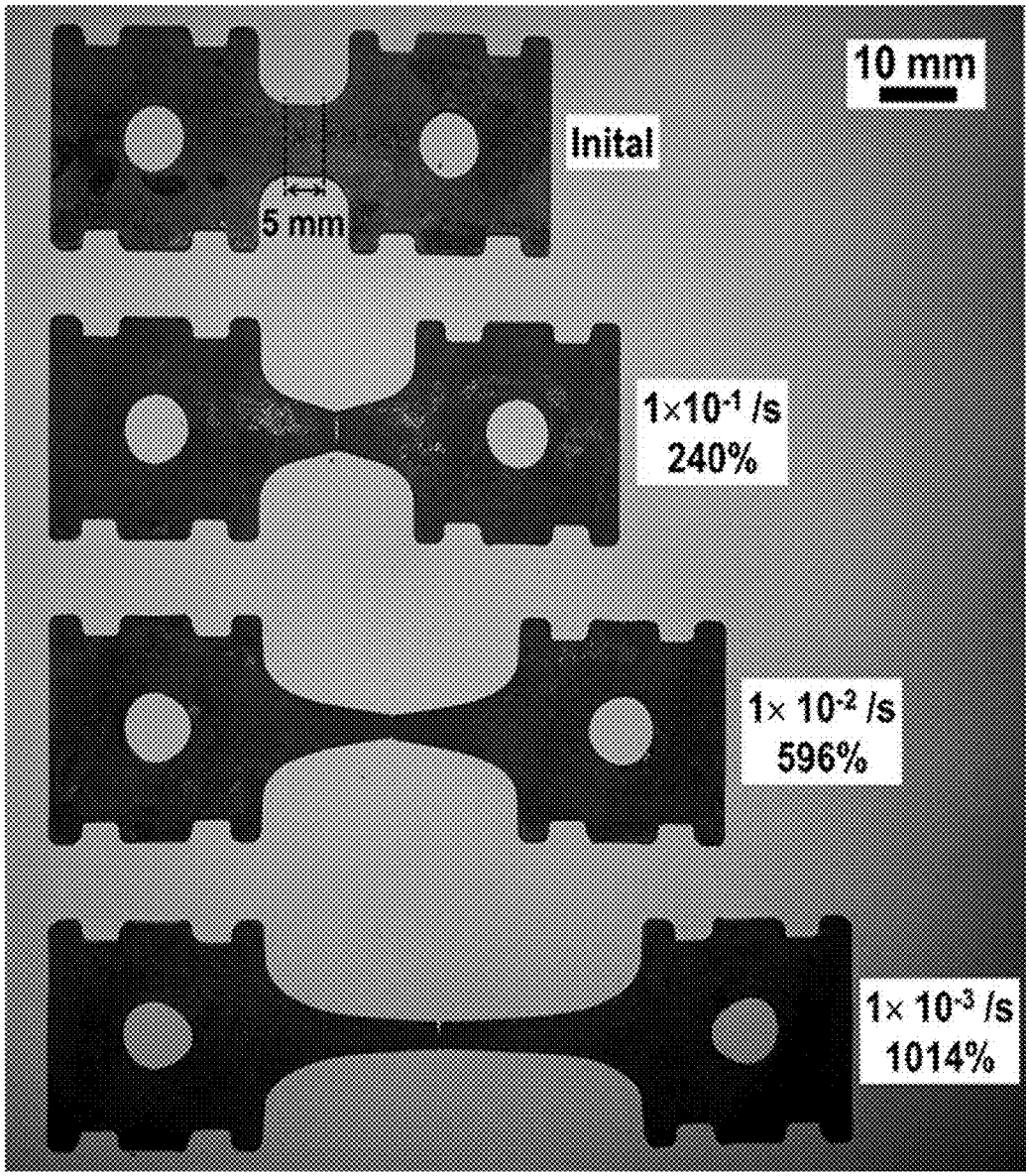
FIG. 3 shows photographs of specimens that were obtained by performing tensile tests on inventive steel 1 at 850° C. and various strain rates.

FIG. 2 shows the tensile curves of inventive steel 1 at various strain rates and 850° C. In this case, the strain rate is strain per second, and was set to a strain rate of $1\times10^{-1}$ $s^{-1}$ or less. FIG. 3 shows the appearance of specimens that were obtained after performing tensile tests under the conditions shown in FIG. 2. From FIGS. 2 and 3, it can be seen that inventive steel 1 exhibits superplasticity under the production method of the present invention and the tensile conditions. In addition, as can be seen from the results in FIG. 2, high elongation is expected, particularly at a slow strain rate of $1\times10^{-3}$ $s^{-1}$ or less. The reason for this is viewed as being that grain boundary sliding occurs sufficiently due to the slow strain rate.

Figure 4:
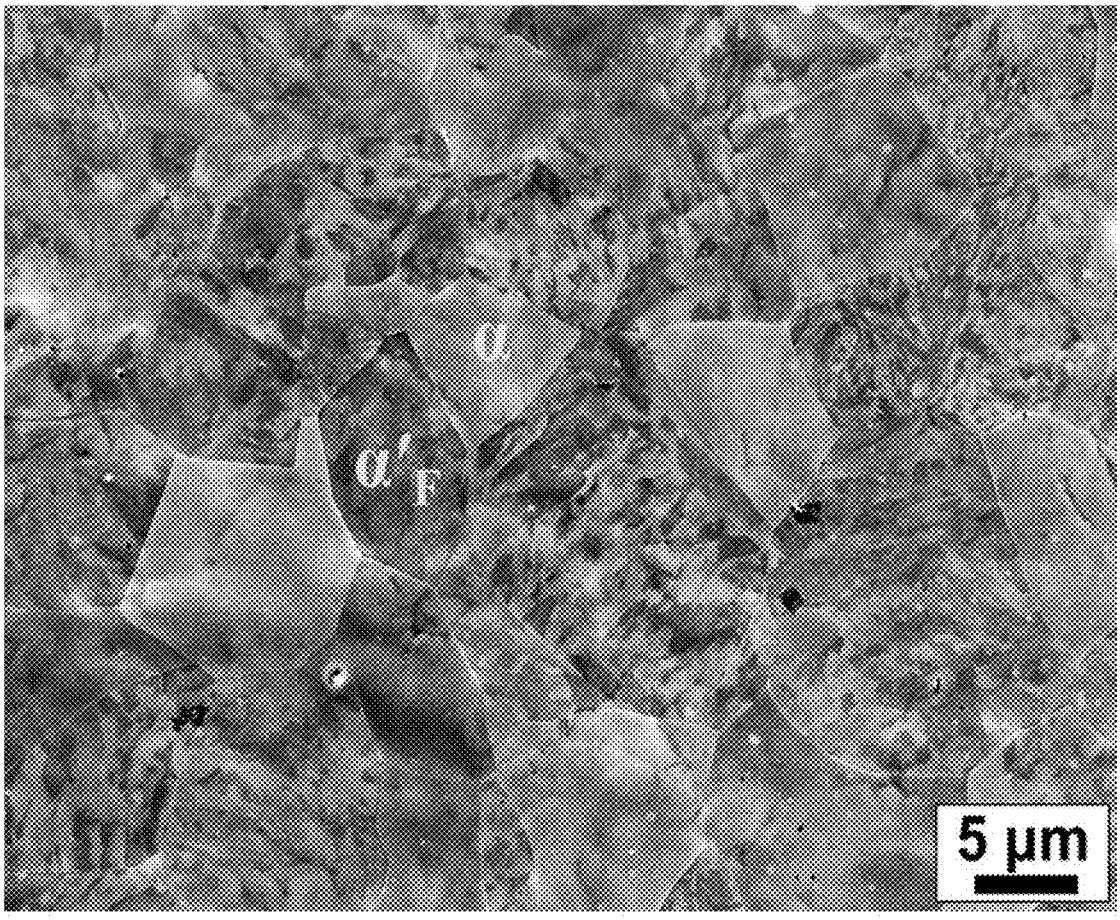
FIG. 4 shows the microstructure of a specimen that was obtained by performing a tensile test on inventive steel 1 under the conditions of 850° C. and $1\times10^{-3}$ $s^{-1}$.
Figure 5A:
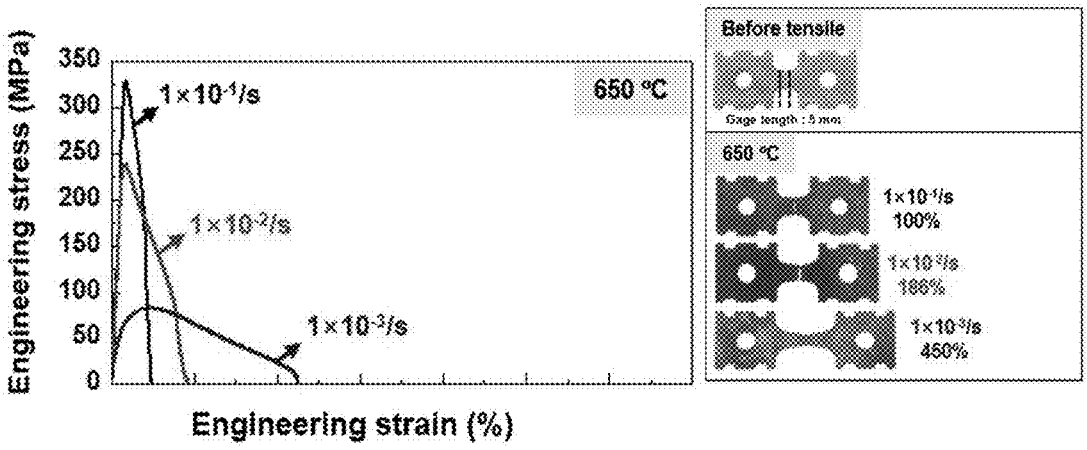
FIGS. 5A to 5E show tensile curves and photographs of specimens that were obtained by cold-rolling inventive steel 1 at a reduction rate of 80% and then performing tensile tests for inventive steel 1 at various temperatures and strain rates.
Figure 5B:
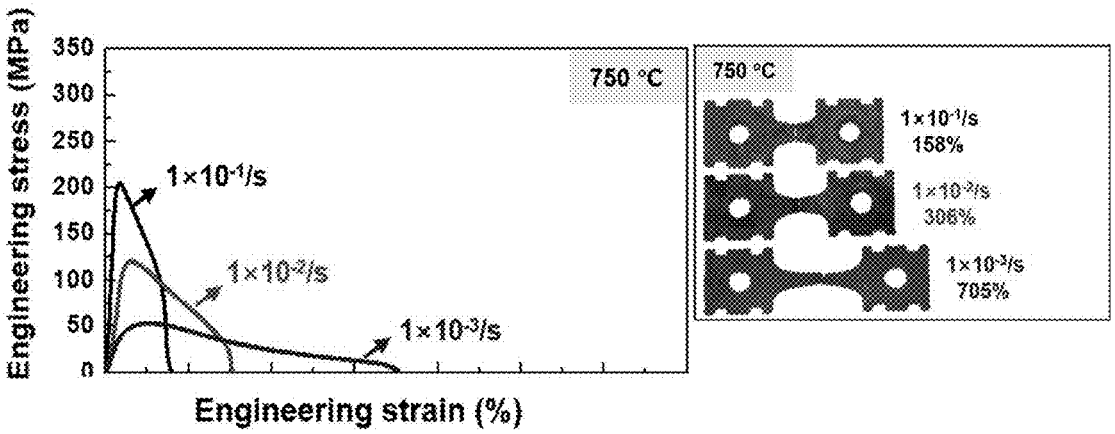
Figure 5C:
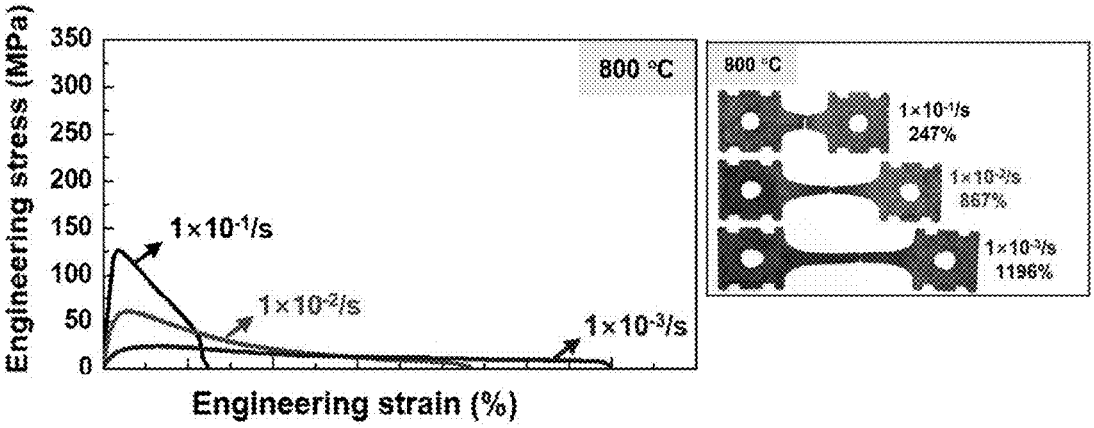
Figure 5D:
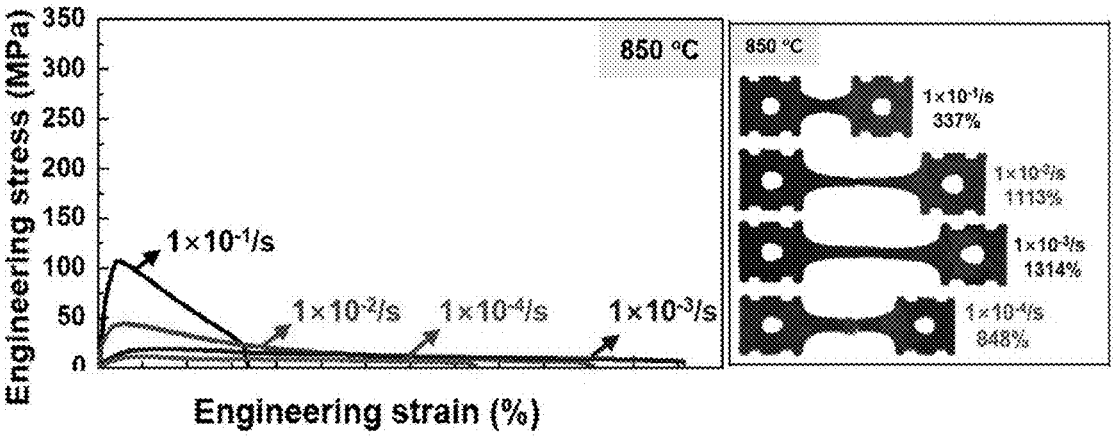
Figure 5E:
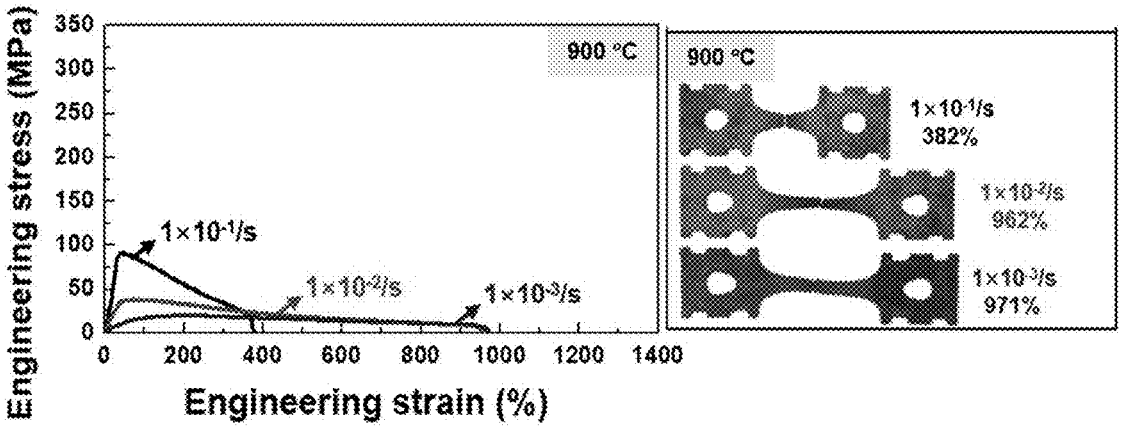

FIG. 4 shows the microstructure of a specimen that was obtained by performing a tensile test on inventive steel 1 under the conditions of 850° C. and $1\times10^{-3}$ $s^{-1}$. As can be seen therein, grains show an equiaxed shape similar to that before deformation (FIG. 1), thus demonstrating that grain boundary sliding occurred actively during tensile deformation at high temperature. For this reason, inventive steel 1 can exhibit superplasticity at high temperatures.

FIGS. 5A to 5E show tensile curves and photographs of specimens that were obtained by cold-rolling inventive steel at a reduction ratio of 80% and then performing tensile tests on inventive steel 1 at various temperatures and strain rates. From FIGS. 5A to 5E, it can be seen that inventive steel 1 exhibits superplasticity under the above-described production process and deformation conditions.

Figure 6A:
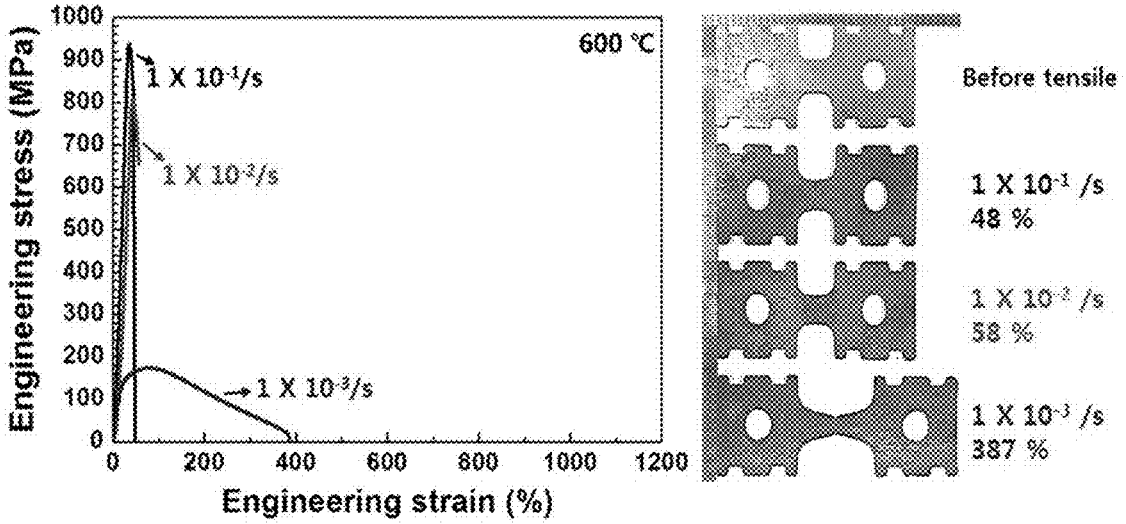
FIGS. 6A to 6C show tensile curves and photographs of specimens that were obtained by cold-rolling inventive steel 2 at a reduction rate of 80% and then performing tensile tests for inventive steel 2 at various temperatures and strain rates.
Figure 6B:
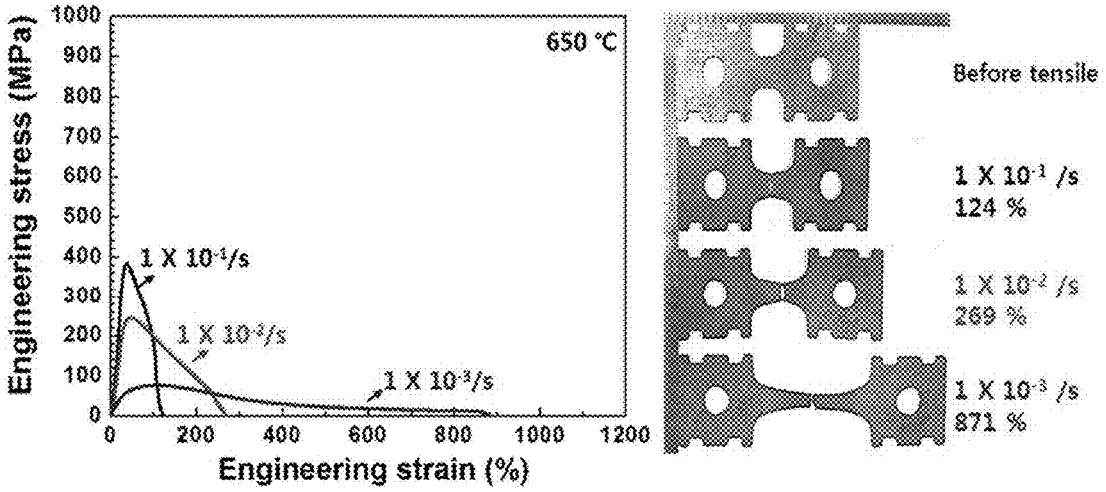
Figure 6C:
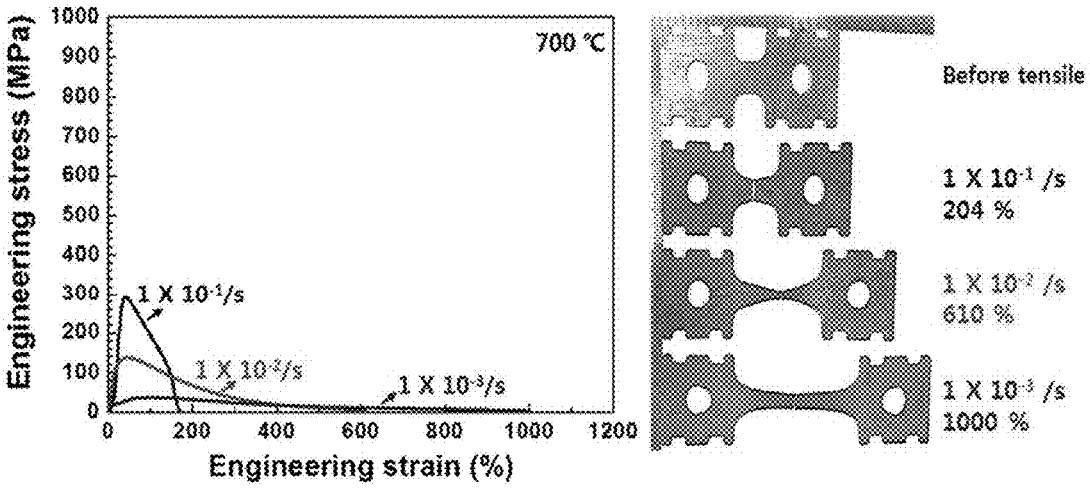

FIGS. 6A to 6C show tensile curves and photographs of specimens that were obtained by cold-rolling inventive steel 2 at a reduction ratio of 80% and then performing tensile tests on inventive steel 2 at various temperatures and strain rates.

Figure 7:
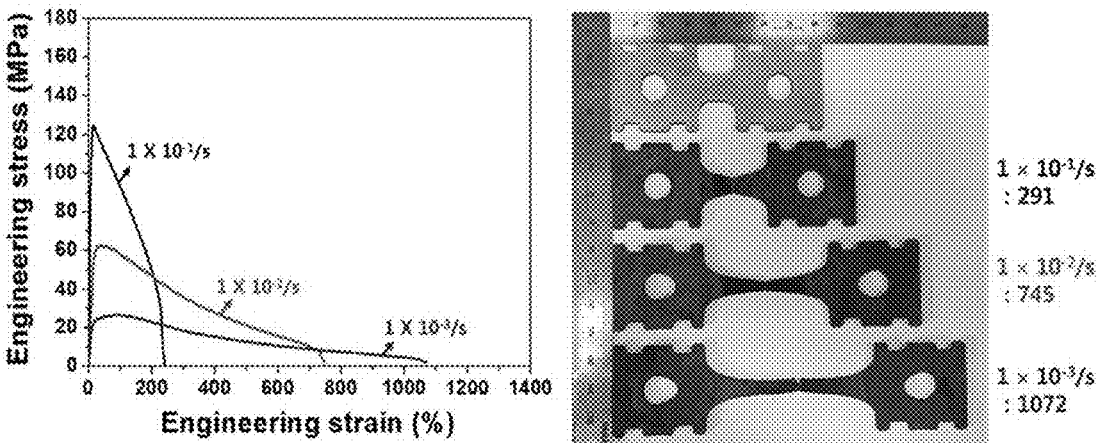
FIG. 7 shows tensile curves and photographs of specimens that were obtained by cold-rolling inventive steel 3 at a reduction rate of 80% and then performing tensile tests on inventive steel 3 at 850° C. and various strain rates.

FIG. 7 shows tensile curves and photographs of specimens that were obtained by cold-rolling inventive steel 3 at a reduction ratio of 80% and then performing tensile tests on inventive steel 3 at 850° C. and various strain rates.

Figure 8:
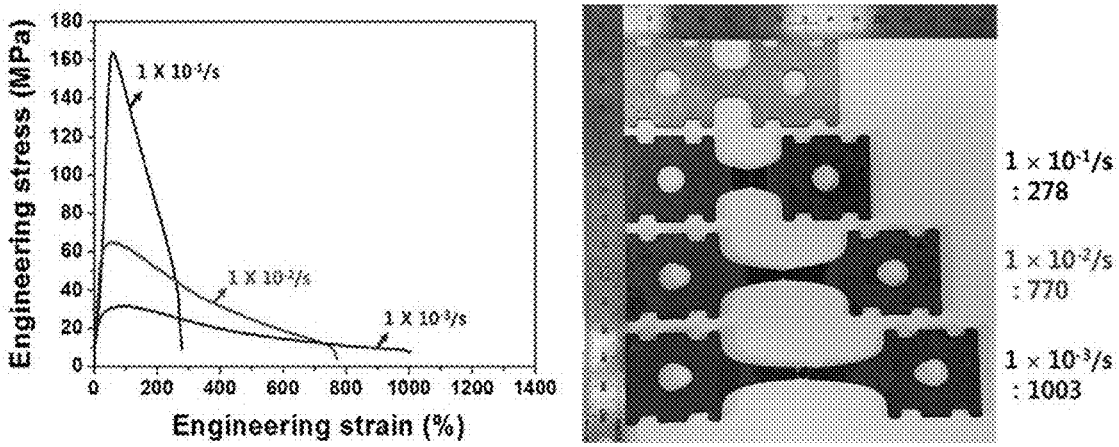
FIG. 8 shows tensile curves and photographs of specimens that were obtained by cold-rolling inventive steel 4 at a reduction rate of 80% and then performing tensile tests on inventive steel 4 at 850° C. and various strain rates.

FIG. 8 shows tensile curves and photographs of specimens that were obtained by cold-rolling inventive steel 4 at a reduction ratio of 80% and then performing tensile tests on inventive steel 3 at 850° C. and various strain rates.

From the above-described tests and data, it can be seen that superplastic medium manganese steels (inventive steels 1 to 4) have been finally developed.

The superplastic medium manganese steel according to the present invention has a total alloying element content of about 10 wt. % or less, which is lower than half of that of the total alloying element of conventional duplex stainless steel, thus indicating that it is very cost-effective and is also effective in saving limited natural resources. Furthermore, the production method according to the present invention is simplified to a cold rolling process following hot rolling, which is a conventional process for producing a commercial steel sheet, thus suggesting that it is actually easily applied to the industry.

In addition, the superplastic medium manganese steel according to the present invention exhibits an elongation of over 1000% at a temperature in the range of about 600 to 900° C., and thus shows formability comparable to that of conventional ferrous superplastic alloys. Furthermore, it has the advantage of having high strength at room temperature because austenite is transformed into martensite during cooling after high temperature deformation.

The superplastic medium manganese steel according to the present invention is expected to be widely applied to aerospace materials requiring high strength and high formability, such as turbine blades, building interior and exterior materials having complex shapes, and car body steel sheets, such as car hoods, trunks or pillars.

The superplastic medium manganese steel and the method of producing the same according to the present invention have the following effects.

First, the superplastic medium manganese steel according to the present invention has the effect of exhibiting superplasticity without containing expensive components, such as chromium (Cr), nickel (Ni) or the like, which have been required in conventional superplastic stainless steel sheets. This also has an additional effect of reducing the production cost.

Second, the superplastic medium manganese steel according to the present invention has the effect of exhibiting superplasticity without a complicated pretreatment process which has been performed for the production of conventional high-carbon superplastic steel sheets. Namely, superplasticity is achieved through the application of general process procedures, whereby the actual applicability of the steel to the industry is improved and the steel productivity is increased.

The effects of the present invention are not limited to those mentioned above, and other effects which are not mentioned can be clearly understood by a person skilled in the art from the above detailed description.

Although the specific embodiments of the present invention have been disclosed for illustrative purposes, those skilled in the art will appreciate that various modifications, additions and substitutions are possible without departing from the scope and spirit of the invention as disclosed in the accompanying claims.

What is claimed is:

1. A method of producing a superplastic medium manganese steel, the method comprising the steps of:

(S1) melting either a medium manganese steel having a composition containing 4 to 8 wt. % of manganese (Mn) and 3 wt. % or less (excluding 0 wt. %) of aluminum (Al), with the remainder being iron (Fe) and inevitable impurities, and excluding silicon (Si), or a medium manganese steel having a composition containing 4 to 8 wt. % of manganese (Mn) and 3 wt. % or less (excluding 0 wt. %) of silicon (Si), with the remainder being iron (Fe) and inevitable impurities, and excluding aluminum (Al), and then homogenizing the medium manganese steel;

(S2) hot-rolling the homogenized medium manganese steel;

(S3) cooling the hot-rolled steel;

(S4) cold-rolling the cooled steel; and (S5) annealing the cold-rolled steel at a predetermined elevated temperature, wherein a microstructure of the superplastic medium manganese steel undergoes a transformation from a martensite single phase structure to a ferrite-austenite dual phase structure.

2. The method of claim 1, wherein a temperature for the homogenizing in step (S1) is 1200° C., and the melting in step (S1) is performed at a temperature equal to or higher than the temperature for the homogenizing.

3. The method of claim 1, wherein the hot rolling in step (S2) is performed at a temperature in a range of 1000 to 1200° C.

4. The method of claim 1, wherein step (S3) is performed by at least one cooling method selected from among water quenching, oil quenching and air cooling.

5. The method of claim 1, wherein the cold rolling in step (S4) is performed at a reduction ratio of 90% or less (excluding 0%).

6. The method of claim 5, wherein the reduction ratio ranges from 60 to 80%.

7. The method of claim 1, wherein the cold rolling in step (S4) is performed at room temperature.

8. The method of claim 1, wherein the predetermined elevated temperature ranges from 600 to 900° C.

9. The method of claim 8, wherein each of the ferrite and the austenite has an average grain size of 2 μm.

* * * * *